US006123748A

United States Patent [19]

Whitaker et al.

[11] Patent Number: 6,123,748

[45] Date of Patent: Sep. 26, 2000

[54] IRON-BASED POWDER

[75] Inventors: Iain R Whitaker; Carl Perrin, both of Rugby, United Kingdom

[73] Assignee: Federal Mogul Sintered Products Limited, West Midlands, United Kingdom

[21] Appl. No.: 09/319,070

[22] PCT Filed: Nov. 25, 1997

[86] PCT No.: PCT/GB97/03221

§ 371 Date: Jun. 1, 1999

§ 102(e) Date: Jun. 1, 1999

[87] PCT Pub. No.: WO98/24941

PCT Pub. Date: Jun. 11, 1998

[30] Foreign Application Priority Data

Nov. 30, 1996 [GB] United Kingdom ..... 9624999

[51] Int. Cl.[7] ..... B22F 1/00

[52] U.S. Cl. ..... 75/252; 75/231; 75/246; 419/37; 419/38

[58] Field of Search ..... 75/252, 231, 243, 75/246; 419/37, 38

[56] References Cited

U.S. PATENT DOCUMENTS 4,770,703 9/1988 Tarutani et al. ..... 75/246

FOREIGN PATENT DOCUMENTS 2 298 869 9/1996 United Kingdom .
94 08061 4/1994 WIPO .

OTHER PUBLICATIONS

Database WPI, Section Ch, Week 8622, Derwent Publciations Ltd., London, GB: Class M22, AN 86–140941 XP002054678 & JP 61 076 650 A (Nissan Motor Co Ltd) see abstract.

Database WPI, Section Ch, Week 9431 Derwent Publciations Ltd., London, GB: Class M22, AN 94–253139 XP002055635 & JP 06 184 603 A (Nippon Steel Corp) see abstract.

*Primary Examiner*—Ngoclan Mai
*Attorney, Agent, or Firm*—Nixon & Vanderhye P.C.

[57] ABSTRACT

An iron-based powder which is a mixture comprising a major proportion of a first alloy powder, a minor proportion of a second alloy powder and a proportion of a solid lubricant. The first alloy powder consists of, in weight percentages, 14 to 30 chromium, 1 to 5 molybdenum, 0 to 5 vanadium, 0 to 6 tungsten, the total of molybdenum, vanadium and tungsten being at least 3, a total of 0 to 5 of other strong carbide forming elements, 0 to 1.5 silicon, carbon with a minimum level sufficient to form carbides with substantially all of the molybdenum, vanadium, tungsten, and any other strong carbide forming elements present, and a balance which is iron and incidental impurities. The second alloy powder is an austenitic stainless steel.

17 Claims, 3 Drawing Sheets

IRON-BASED POWDER

This invention is concerned with an iron-based powder for use in manufacturing a component by a powder metallurgy route (PM).

It is well known to manufacture components by the PM route, i.e. by preparing an iron-based powder, compacting the powder to form a "green" body, and then sintering so that the powder fuses together to form the component. In some cases, the powder is a mixture of elemental powders with iron predominating, and, in other cases, the powder comprises an alloy of iron and other elements (such alloyed powders can be produced by water atomisation). It is also known to mix alloyed powder with elemental iron, and to mix different alloyed powders. The PM route provides many advantages, particularly in reduced machining.

Indeed, due to the nature of products produced by known methods of powder metallurgy, it is desired that a minimum degree of machining be required. Products produced by known methods of powder metallurgy, since they are not full density products, can suffer from the phenomenon known as chattering, which damages both the products and the machining tool. This problem is accentuated when the mixture from which the product is formed contains a powder of a tool steel, which may result in excessive tool wear.

It has been recognised that it would be desirable to utilise the PM route for the manufacture of components which need to operate in conditions requiring hot oxidation resistance, e.g. at temperatures of up to 850° C., and in the presence of corrosive gas. An example of such an application is a turbocharger wastegate valve bushing which operates in an exhaust gas environment. Such bushings are conventionally made from high chromium cast iron or austenitic steel. However, hitherto, bushings of this type manufactured by a PM route have not proved to be satisfactory, being, for example, prone to causing seizure due to swelling.

GB 2 298 869 A discloses an alloy powder having a composition consisting of, in weight percentages, 14 to 30 chromium, 1 to 5 molybdenum, 0 to 5 vanadium, 0 to 6 tungsten, the total of molybdenum, vanadium and tungsten being at least 3, a total of 0 to 5 of other strong carbide forming elements, e.g. niobium, tantalum, and titanium, 0 to 1.5 silicon, carbon with a minimum level sufficient to form carbides with the all of the molybdenum, vanadium, tungsten, and any other strong carbide forming elements present, and a balance which is iron and incidental impurities. The maximum level of carbon is expressed as one fifth of the chromium content minus 2. Examples are given comprising 20 to 28 chromium, 2 to 3 molybdenum, 1.5 to 2.5 vanadium, 2.5 to 3.5 tungsten, 0.8 to 1.5 silicon, and 0.555 to 2 carbon. The powder is produced by rapid atomisation followed by an annealing treatment and has a substantially fenitic matrix containing at least 12% of chromium in solution and a dispersion of carbides.

Components made from the alloy powders disclosed in GB 2 298 869 A do not exhibit good hot oxidation resistance. It is also proposed in GB 2 298 869 A that the wear resistance of components made from conventional stainless steel powders can be improved by blending the stainless steel powder with the powder disclosed therein. An example is given of 80% stainless steel to 20% of the disclosed alloy powder. However, blends of minor proportions of the disclosed powder with stainless steel powder do not result in components with good hot oxidation resistance.

Further, GB 2 298 869 A, in discussing manufacture of a product from a mixture of conventional stainless steel powder and the powder disclosed therein, does not disclose any unexpected advantageous physical or mechanical properties arising as a result of the combination of these powders. Rather the hardness of the disclosed powder is brought to the mixture to enhance the hardness of the softer conventional stainless steel powder, and in the absence of any indications to the contrary the properties of the products formed from the powder mixture will be largely those of the stainless steel powder used.

However, there remain applications where it would be desirable further to tune the properties of the final product. For example, one may desire to alter the thermal expansion coefficient of the final product produced from a mixture of powders to match more closely over an entire temperature range of operation the thermal expansion coefficient of components with which the final product comes into mating engagement. Such a situation may arise when the final product and other components are subject to interference fitting or relative mechanical motion.

It is an object of the present invention to provide an iron-based powder which enables components, which are capable of operating satisfactorily in the conditions mentioned-above, to be produced by the PM route.

Components produced from the powder mixture according to the present invention have as a further advantage the substantial elimination of the chattering effect during machining, enabling the manufacture of such components which may subsequently be machined to high tolerances. It is also an advantage-of the present invention that such machined components have an excellent surface finish. In addition, the improved machining characteristics of the present invention lead to the machining tool having a longer life.

The invention provides an iron-based powder which is a mixture comprising a major proportion of a first alloy powder, a minor proportion of a second alloy powder, and a proportion of solid lubricant, the first alloy powder consisting of, in weight percentages, 14 to 30 chromium, 1 to 5 molybdenum, 0 to 5 vanadium, 0 to 6 tungsten, the total of molybdenum, vanadium and tungsten being at least 3, a total of 0 to 5 of other strong carbide forming elements, 0 to 1.5 silicon, carbon with a minimum level sufficient to form carbides with substantially all of the molybdenum, vanadium, tungsten, and any other strong carbide forming elements present, and a balance which is iron and incidental impurities, the second alloy powder being an austenitic stainless steel.

It is found that a powder according to the invention enables components with satisfactory performance in the conditions mentioned to be manufactured by a one step cold compaction and one step sintering PM route. The first alloy powder gives good wear resistance and corrosion resistance. The second alloy powder contributes to green strength, reduces porosity, and increases corrosion resistance. The second alloy powder also increases the coefficient of thermal expansion, allowing tuning of this parameter for compatibility with co-operating components Preferably the solid lubricant comprises up to 30% of the mixture. More preferably the solid lubricant comprises up to 5% of the mixture. Preferably the solid lubricant comprises Molybdenum Disulphide ($MoS_2$).

Powder according to the invention was compared with a comparison powder comprising only the first alloy powder and was found to have increased compressibility. Components manufactured from a powder according to the invention were found to have improved hot oxidation resistance, an increased coefficient of thermal expansion, and increased density, in comparison with components manufactured from the comparison powder.

Preferably, said first alloy powder comprises, in weight percentages, 20 to 28 chromium, 2 to 3 molybdenum, 1.5 to 2.5 vanadium, 2.5 to 3.5 tungsten, 0.8 to 1.5 silicon, 0.555 to 2 carbon, and a balance which is iron and incidental impurities.

Preferably, the second alloy powder comprises, in weight percentages, 1 to 37 nickel, 12 to 28 chromium, 0 to 19 manganese, 0 to 7% molybdenum, a maximum of 1 niobium, a maximum of 0.4 nitrogen, a maximum of 0.2 carbon, and a balance which is iron and incidental impurities. In particular, the second alloy powder may comprise, in weight percentages, 8 to 16 nickel, 12 to 20 chromium, 0 to 4 molybdenum, less than 0.1 carbon, and a balance which is iron and incidental impurities. Good results were obtained when said second alloy powder comprised, in weight percentages, 11 to 13 nickel, 16.2 to 17.2 chromium, 1 to 3 molybdenum, and 0 to 1 silicon.

In a powder according to the invention, said mixture may comprise 50 to 95% by weight of the first alloy powder. Good results have been obtained when this percentage was between 70 and 80. The proportion of the second alloy powder can be adjusted to adjust the coefficient of thermal expansion, e.g. where the component is a turbocharger bushing, its coefficient of thermal expansion can be matched with that of its housing. The coefficient of thermal expansion can be greater than $12\times10^{-6}$° C.$^{-1}$.

In a powder according to the invention, said mixture may also comprise an addition of up to 1% by weight of free carbon.

The mixture may also comprise a sintering aid, e.g. up to about 0.5% by weight of phosphorus.

The invention also provides use of a powder in accordance with the invention, for manufacturing a component having hot oxidation resistance by a powder metallurgy route.

There now follow detailed descriptions, to be read with reference to the accompanying drawings, of illustrative Examples according to the invention.

EXAMPLE 1

In the illustrative examples, an iron-based powder was made by mixing a first water-atomised alloy powder, a second water-atomised alloy powder, a solid lubricant, and a standard binder. The first alloy powder had a composition (in percentages by weight) of: 24.3 chromium, 3.1 molybdenum, 2.2 vanadium, 3.2 tungsten, 1.6 carbon, 1.3 silicon, and a balance consisting of iron and incidental impurities (mainly sulphur about 0.1%). The second alloy powder had a composition (in percentages by weight) of: 12.7 nickel, 17.1 chromium, 2.3 molybdenum, 0.9 silicon, 0.025 carbon, and a balance consisting of iron and incidental impurities. The solid lubricant was molybdenum disulphide and the binder was Acrawax.

Figure 1:
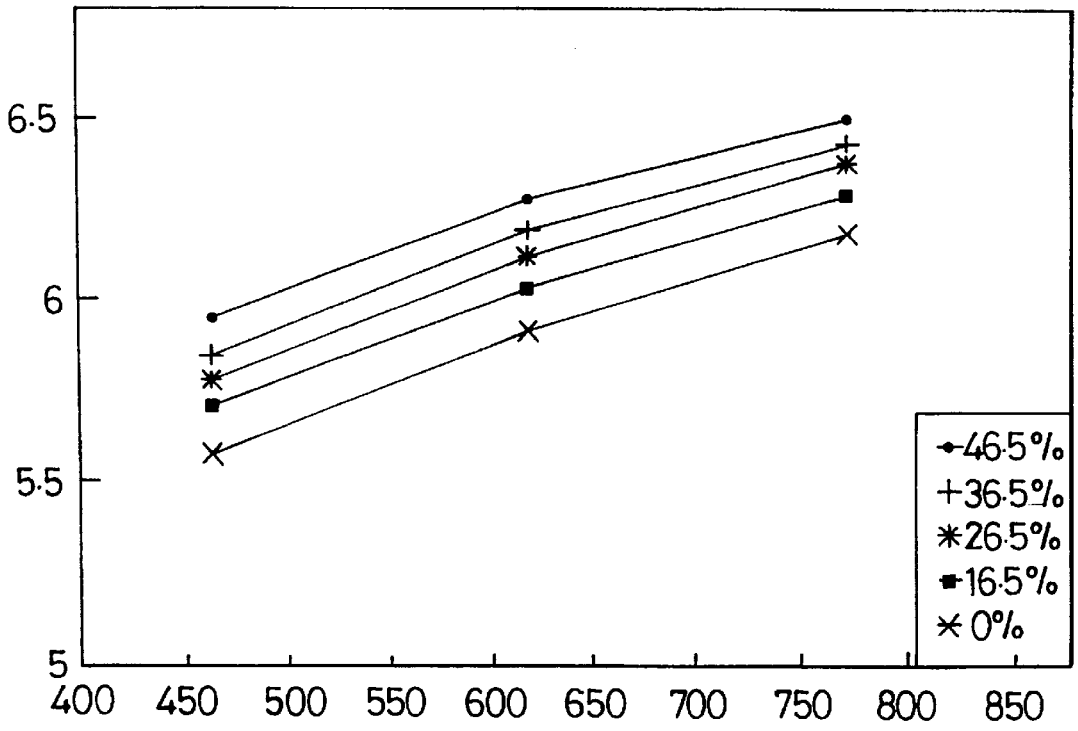
FIG. 1 is a graph in which compaction pressure in MPa (x axis) is plotted against green density in Mg/m$^3$.

In a first illustrative example, the mixture comprised 70% of the first alloy powder, 26.5% of the second alloy powder, and 3.5% of the solid lubricant. To this 0.5% of the binder was added. Samples of the mixture were pressed to form a green body at compaction pressures illustrated in FIG. 1 by stars. FIG. 1 illustrates the densities achieved in the first example. FIG. 1 also illustrates the densities achieved with a comparison powder (shown by diagonal crosses). The comparison powder had none of the second alloy, being 96.5% of the first alloy and 3.5% of the solid lubricant.

In the first illustrative example, the green bodies were then dewaxed at a temperature of 650° C. and sintered at 1110° C. in a mesh belt sintering furnace. The sintered components had densities up to 6.27 Mgm$^3$.

The sintered components made by the first example were found to have a hardness of 59 HRA. The components were also subjected to wear tests and corrosion tests (in particular a hot oxidation test illustrated by FIG. 3) and were found to be suitable for use in high temperature applications and in the presence of exhaust gases.

Figure 2:
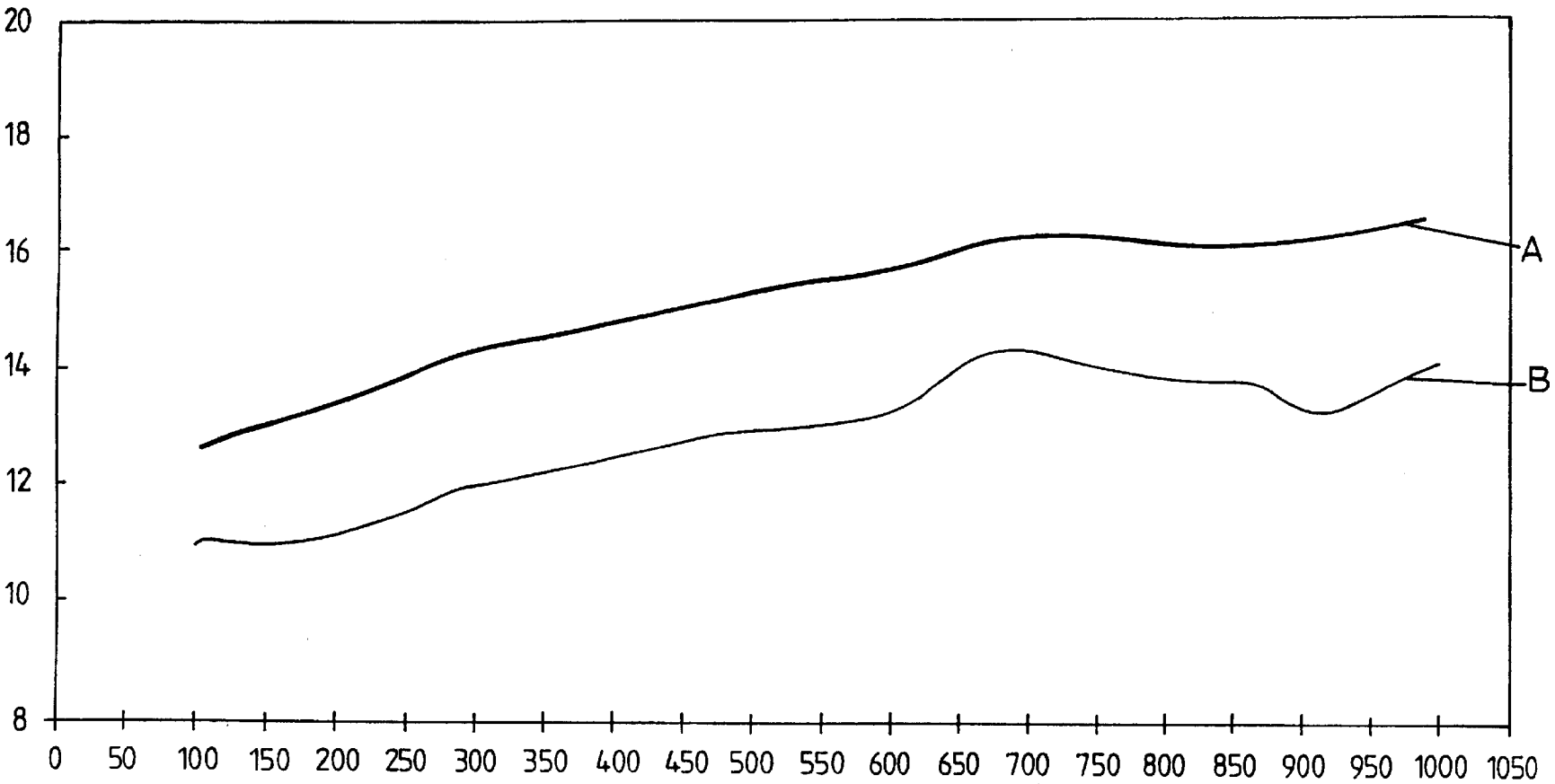
FIG. 2 is a graph in which coefficient of thermal expansion in units of $10^{-6}$ mm/mm/° C. (y axis) is plotted against temperature in ° C.
Figure 3:
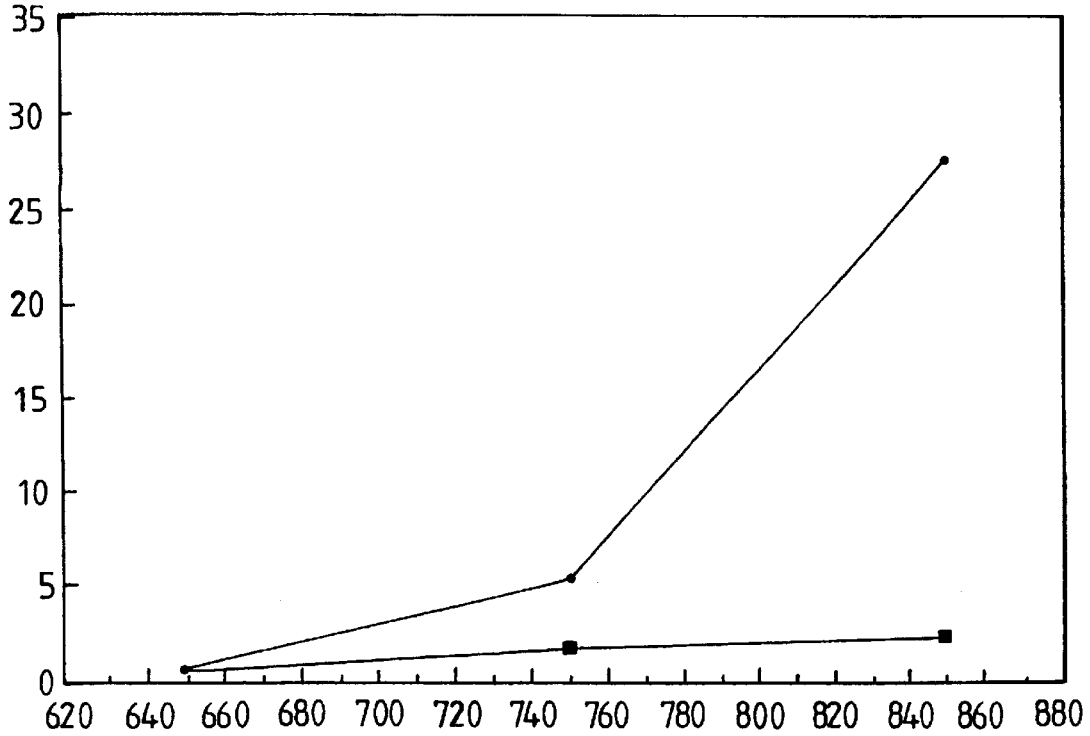
FIG. 3 is a graph in which percentage of weight gain in 24 hours in a hot oxidation resistance test (y axis) is plotted against temperature in ° C.

As shown in FIG. 2, the components made by the first illustrative example were tested to determine their coefficient of linear thermal expansion over a temperature range. The line A in FIG. 2 shows the results while the line B shows the results obtained for components made from the comparison powder mentioned-above. FIG. 3 shows the components from the first illustrative example as small squares and those from the comparison powder as large squares. From FIG. 3, it can be seen that the hot oxidation resistance of the comparative example becomes progressively worse at higher temperatures while that of the first illustrative example is not only better but also increases at a much lower rate as temperature increases.

A friction test was then conducted on samples according to this example. The test involved taking these samples and placing each sample in a test rig. In the test rig each end of the sample was placed in a bushing, each bushing subsequently being loaded to 2 kg to produce a downward force on each end of the sample. The sample was then heated to about 600° C. in a hot diesel exhaust environment. The sample was then rotated at 20 cycles per minute in this environment for 110 hours of continuous testing. The bearing pressure under these conditions was about 0.1 MPa and the coefficient of friction during testing was found to be between 0.15 and 0.5.

EXAMPLE 2

In a second illustrative example, the first example was repeated except that the sintering was vacuum sintering at 1200° C. The components had a hardness of 50 HRA and the sintered densities were up to 6.53 Mgm$^{-3}$. The components also passed the wear and corrosion resistance tests.

EXAMPLE 3

In further Illustrative examples, the percentage of the second alloy powder was varied with the percentage of the first alloy powder being altered to make up the difference.

With 46.5% of the second alloy powder, green densities shown by small squares in FIG. 1 were achieved and a hardness of 230 kg/mm$^2$. A block and ring wear test was conducted on samples according to this example The wear occurring during the test produces a scar profile. The geometry of the scar profile can then be used to determine the volume of material removed during the test—the wear loss. In the wear test, a loss of 1.50 mm$^3$ was observed.

With 36.5% of the second alloy powder, green densities shown by crosses in FIG. 1 were achieved and the hardness was 246 kg/mm$^2$. In the wear test, the wear loss was 1.8 mm$^3$. With 16.5% of the second alloy powder, the green densities shown by large squares were achieved and the hardness was 270 kg/mm$^2$. In the wear test, the wear loss was 2.1 m$^3$. The test results indicate that a mixture of powders according to the invention enables components to be manufactured by a PM route, the components having an improved hot oxidation resistance but only slightly reduced wear resistance in comparison with components made from the first alloy powder, i.e. without an austenitic stainless steel component.

EXAMPLE 4

A further set of illustrative Examples were prepared using a commercially available austenitic stainless steel having the designation 316L. Across the range of the samples, as the level of solid lubricant was increased by a set amount the amounts of the first alloy and the austenitic stainless steel were each reduced, such that a ratio of 2.6:1 of the first alloy to the austenitic stainless steel was maintained. The samples were made by preparing a mixture of the first alloy, the stainless steel and the solid lubricant as required. Each mixture was pressed to form a green compact. The green compact was then heated at 10° C./min to a temperature of about 600° C. and held at that temperature for 30 minutes. The samples were then heated at 100° C./min to about 900° C. and held at that temperature for 30 minutes. Finally the samples were heated at 5° C./min under near vacuum of 4 mbar Ar to about 1175° C. and held at that temperature for 60 minutes before being allowed to cool to room temperature.

Each of the samples were subjected to a hot oxidation test. The samples were maintained at a constant temperature of about 750° C. for 24 hours and the weight gain for each sample was determined. The weight gain is illustrative of the amount of oxide formed on each sample. It was found that at up to 30% Molybdenum Disulphide a satisfactory result could be obtained in that less than 1% weight gain was detected.

When oxide forms, it forms in the interstices or pores of the sintered material, eventually causing the sintered material to fracture as the volume of the oxide becomes greater than the volume of the pores in which it is forming. Clearly the fracture of a PM part is best avoided, and a part that forms little oxide while maintaining its physical properties is thus desirable.

EXAMPLE 5

A further set of Illustrative Examples was prepared. The samples were substantially identical, each sample containing determined amounts of each of the first alloy, the second alloy and the solid lubricant. In each case the powder mixture was sintered in a Walking Beam furnace in a Nitrogen/Hydrogen atmosphere.

The samples were sintered at various temperatures. It was found that a sintering temperature of above about 1230° C. was required to produce samples that could be machined without causing above average wear to the machine tools.

What is claimed is:

1. An iron-based powder for use in manufacturing a component by a powder metallurgy route, which powder is a mixture including a first alloy powder consisting of, in weight percentages, 14 to 30 chromium; 1 to 5 molybdenum; 0 to 5 vanadium; 0 to 6 tungsten; the total of molybdenum, vanadium and tungsten being at least 3; a total of 0 to 5 of other strong carbide forming elements; 0 to 1.5 silicon; 0.555 to 2 carbon, with a minimum amount sufficient to form carbides with substantially all of the molybdenum, vanadium, tungsten, and any other strong carbide forming elements present; and the balance is iron together with incidental impurities;

a second alloy powder of an austenitic stainless steel;

wherein the iron-based powder also includes a finite amount of a solid lubricant up to 30% by weight thereof; and wherein, by weight, the major portion of the combination of the first alloy powder and the second alloy powder comprises the first alloy powder, with the second alloy powder comprising the minor portion of this combination.

2. A powder according to claim 1 wherein said allow powder comprises in weight percentages, 20 to 28 chromium, 2 to 3 molybdenum, 1.5 to 2.5 vanadium, 2.5 to 3.5 tungsten, 0.8 to 1.5 silicon, and 0.555 to 2 carbon.

3. A powder according to 1 or 2, wherein the second alloy powder comprises 1 to 37% of nickel, 12 to 28% of chromium, 0 to 19% manganese, 0 to 7% molybdenum, a maximum of 1% niobium, a maximum of 0.4% nitrogen, a maximum of 0.2% of carbon, and the balance is iron, together with incidental impurities all percentages being by weight.

4. A powder according to claim 3, wherein the second alloy powder comprises 8 to 16% of nickel, 12 to 20% of chromium, 0 to 4% molybdenum, less than 0.1% of carbon, all percentages being by weight.

5. A powder according to claim 4, wherein said second alloy powder comprises 11 to 13% of nickel, and 16.2 to 17.2% of chromium in weight percentages.

6. A powder according to claim 5, wherein said second alloy comprises 1 to 3% by weight of molybdenum.

7. A powder according claim 1, wherein said combination of the first alloy powder and the second alloy powder comprises to 95% by weight of the first alloy powder.

8. A powder according to claim 1, including an addition of up to 1% by weight of free carbon.

9. A powder according to claim 1, including a sintering aid.

10. A powder according to claim 1, characterised in that the solid lubricant comprises up to 5% by weight.

11. A powder according to claim 10 characterised in that the solid lubricant comprises molybdenum disulphide.

12. A component manufactured by a powder metallurgy route from a powder according to claim 1.

13. A method of manufacturing a component according to claim 12, including a sintering process step to fuse iron-based powder together.

14. A method according to claim 13, including the initial process step of compacting the iron-based powder to form a green body.

15. An assembly of a component according to claim 12 and another component of a different material, wherein the proportion of the second alloy powder of the first mentioned component is arranged so that the coefficients of thermal expansion of the components are matched with each other over a significant temperature range.

16. An assembly according to claim 15, wherein the first mentioned component is a turbocharger bushing, and the other component is its housing.

17. An assembly according to claim 15, wherein the coefficient of thermal expansion of the first mentioned component is greater than $12\times10^{-6}$ per $^0$C.

* * * * *